US008928561B2

(12) United States Patent
Chen

(10) Patent No.: US 8,928,561 B2
(45) Date of Patent: Jan. 6, 2015

(54) METHOD AND DEVICE FOR REDUCING SHUTTER 3D LIQUID CRYSTAL DYNAMIC CROSSTALK AND LIQUID CRYSTAL DISPLAY DEVICE

(75) Inventor: Yu-Yeh Chen, Guandong (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 184 days.

(21) Appl. No.: 13/643,082

(22) PCT Filed: Aug. 16, 2012

(86) PCT No.: PCT/CN2012/080249

§ 371 (c)(1),
(2), (4) Date: Oct. 24, 2012

(87) PCT Pub. No.: WO2014/026365

PCT Pub. Date: Feb. 20, 2014

(65) Prior Publication Data

US 2014/0049523 A1 Feb. 20, 2014

(30) Foreign Application Priority Data

Aug. 14, 2012 (CN) ..... 2012 1 028 8236

(51) Int. Cl.

*G09G 3/20* (2006.01)
*G09G 3/34* (2006.01)
*G09G 3/00* (2006.01)

(52) U.S. Cl.

CPC ..... *G09G 3/3433* (2013.01); *G09G 3/003* (2013.01); *G09G 2320/0209* (2013.01); *G09G 2360/16* (2013.01)

USPC ..... 345/58; 345/690; 345/89

(58) Field of Classification Search

CPC ..... G09G 2320/0209; G09G 2360/16; G09G 3/003; G09G 3/3433

USPC ..... 345/204, 58, 89, 690

See application file for complete search history.

(56) References Cited

U.S. PATENT DOCUMENTS

| | | | | |
|---|---|---|---|---|
| 2010/0165222 | A1* | 7/2010 | Choi | 349/15 |
| 2012/0007895 | A1* | 1/2012 | Kim et al. | 345/690 |
| 2012/0086706 | A1* | 4/2012 | Lee et al. | 345/419 |
| 2013/0229498 | A1* | 9/2013 | Yano et al. | 348/51 |

* cited by examiner

*Primary Examiner* — Long D Pham
(74) *Attorney, Agent, or Firm* — Andrew C. Cheng

(57) ABSTRACT

The present invention discloses a method for reducing shutter 3D liquid crystal dynamic crosstalk, which includes: receiving digital information of left-eye and right-eye images of a current frame; comparing to determine if a combination of the left-eye and right-eye gray levels of each pixel point of each scanning line of the current frame is equal to that of the previous frame; adjusting the gray level of the image of one of the eye images that is associated with each pixel point having left-eye image and right-eye image gray levels that are both different between the current frame and the previous frame resulting from the comparison result according to a gray level reference table; and displaying one eye image of all the scanning lines of the current frame that have been subjected to gray level adjustment and another one image of the current frame that has not been subjected to adjustment.

9 Claims, 5 Drawing Sheets

| current frame (left eye/right eye) | target gray level (left eye) |
|---|---|
| 255/0 | 249 |
| 255/1 | 249 |
| 255/2 | 248 |
| … | … |
| 255/254 | 249 |
| 254/0 | 247 |
| 254/1 | 247 |
| 254/2 | 247 |
| … | … |
| 254/253 | 247 |
| 253/0 | 242 |
| 253/1 | 242 |
| 253/2 | 242 |
| … | |
| 253/252 | 242 |
| 252/0 | 238 |
| … | … |
| 3/0 | 34 |
| 3/1 | 34 |
| 3/2 | 34 |
| 2/0 | 31 |
| 2/1 | 31 |
| 1/0 | 30 |

Figure 3

| current frame (left eye/right eye) | target gray level (right eye) |
|---|---|
| 255/0 | 20 |
| 255/1 | 22 |
| 255/2 | 25 |
| … | … |
| 255/254 | 247 |
| 254/0 | 21 |
| 254/1 | 23 |
| 254/2 | 25 |
| … | … |
| 254/253 | 245 |
| 253/0 | 22 |
| 253/1 | 25 |
| 253/2 | 29 |
| … | |
| 253/252 | 238 |
| 252/0 | 25 |
| … | … |
| 3/0 | 29 |
| 3/1 | 30 |
| 3/2 | 33 |
| 2/0 | 28 |
| 2/1 | 30 |
| 1/0 | 28 |

Figure 4

METHOD AND DEVICE FOR REDUCING SHUTTER 3D LIQUID CRYSTAL DYNAMIC CROSSTALK AND LIQUID CRYSTAL DISPLAY DEVICE

CROSS REFERENCE TO RELATED APPLICATIONS

This application claims the priority of Chinese Patent Application No. 201210288236.0 filed on Aug. 14, 2012, the disclosure of which is incorporated herein by reference in its entirety.

BACKGROUND OF THE INVENTION

1. Field of the Invention

The present invention relates to shutter 3D liquid crystal displaying techniques, and in particular to a method and a device for reducing shutter 3D liquid crystal dynamic crosstalk and a liquid crystal display device.

2. The Related Arts

The operation principle of shutter 3D liquid crystal displaying is to have the liquid crystal panels alternately display left-eye images and right-eye images, while controlling opening/closing of shutter glasses to allow the left eye of a user to see the left-eye image and the right eye seeing the right-eye image. If the left eye sees the right-eye image and the right eye sees the left-eye image, then the eyes of the user will perceive a phenomenon referred to as crosstalk.

Due to the "holding" characteristics of the liquid crystal, it requires a certain amount of time to respond and this makes the previous frame of image that is under incomplete response retaining on the current frame of image that is being displayed by the liquid crystal panel. If the liquid crystal panel itself cannot identify the images for left and right eyes, then there is always crosstalk regardless how fast we can adjust the synchrony of the shutter glasses. Particularly, the crosstalk phenomenon will easily occur when the current left-eye image and the previous left-eye image, and the current right-eye image and the previous right-eye image are all varied. The crosstalk caused by such a situation is referred to as dynamic crosstalk (because the left-eye image and right-eye image crosstalk is caused by dynamic images).

To reduce such a crosstalk and the dynamic crosstalk, a common solution is to compress the time for transmission of image data of each frame or backlight scanning techniques may be adopted to improve dynamic response of images, or the left and right eyes are simultaneously subjected to dynamic driving (namely adjustment of gray scale).

It is noticed by the inventor that although adopting backlight scanning techniques reduces crosstalk to some extents, yet the effectiveness is limited and the expense is high. Compressing the time for transmission of image data of each frame is limited by compression rate and thus the effectiveness of reducing displaying crosstalk is limited. Subjecting left and right eyes to dynamic driving simultaneously may increase static left-eye and right-eye crosstalk. To summarize, the known techniques do not provide good result for reducing the crosstalk problem of shutter 3D liquid crystal display device.

SUMMARY OF THE INVENTION

The technical issue to be addressed by the present invention is to provide a method and a device for reducing shutter 3D liquid crystal dynamic crosstalk and a liquid crystal display device, in order to effectively alleviate the left-eye and right-eye dynamic crosstalk problem existing in shutter 3D liquid crystal display device.

To address the above technical issue, on the one hand, an embodiment of the present invention provides a method for reducing shutter 3D liquid crystal dynamic crosstalk, which comprises:

receiving digital information of left-eye image and right-eye image of a current frame;

comparing to determine if a combination of the left-eye and right-eye gray levels of each pixel point of each scanning line of the current frame is equal to a combination of left-eye and right-eye gray levels of the corresponding position of the previous frame;

adjusting the gray level of the image of one of the eye images that is associated with each pixel point having left-eye image and right-eye image gray levels that are both different between the current frame and the previous frame resulting from the comparison result according to a gray level reference table corresponding to the scanning line in which the pixel point is located so as to adjust the gray level of each pixel point of one of the eye images of the current frame to a corresponding target gray level; and displaying one eye image of all the scanning lines of the current frame that have been subjected to gray level adjustment and another one image of the current frame that has not been subjected to adjustment.

Preferably, the gray level reference table for each scanning line is defined in advance and in the gray level reference table, each combination of left-eye gray level and right-eye gray level of the current frame is associated with a target gray level. The target gray level includes a left-eye target gray level and a right-eye target gray level.

Preferably, the step of displaying one eye image of all the scanning lines of the current frame that have been subjected to gray level adjustment and another one image of the current frame that has not been subjected to adjustment further comprises:

storing the image of one eye that has been subjected to gray level adjustment so as to have the image that has been subjected to gray level adjustment to form a sequence with the image of the other eye that has not subjected to adjustment.

Preferably, the step of adjusting the gray level of the image of one of the eye images that is associated with each pixel point having left-eye image and right-eye image gray levels that are both different between the current frame and the previous frame resulting from the comparison result according to a gray level reference table corresponding to the scanning line in which the pixel point is located so as to adjust the gray level of each pixel point of one of the eye images of the current frame to a corresponding target gray level comprises:

searching a previously stored gray level reference table corresponding to the scanning line where the pixel is located according to the position of each pixel of which the comparison result is different to find out each target gray level corresponding to the combination of left-eye and right-eye gray levels of the current frame for each pixel;

adjusting the left-eye gray level of the pixel where the comparison result of the left-eye gray level and the right-eye gray level are both different between the current frame and the previous frame to the corresponding left-eye gray level or adjusting the right-eye gray level to the corresponding right-eye target gray level.

Preferably, each target gray level of the gray level reference table corresponding to each scanning line satisfies the following conditions:

in all combinations of left-eye and right-eye gray levels for one pixel point of each scanning line of the current frame, with the combinations of left-eye and right-eye gray levels of the pixel point remaining unchanged between the previous frame and the next frame, the lowest brightness level or the greatest brightness level of one eye that is measured for the pixel point of the current frame is taken as a reference brightness level; and in the gray level reference table corresponding to the scanning line, the combination of gray levels of a corresponding eye of the combination of left-eye and right-eye gray levels for the current frame is replaced with the target gray level to form an adjusted combination of left-eye and right-eye gray levels and the lowest brightness level or the greatest brightness level of the adjusted combination of left-eye and right-eye gray levels is measured to be within a deviation of 3% with respect to the corresponding reference brightness level.

On the other hand, the present invention provides a device for reducing shutter 3D liquid crystal dynamic crosstalk, which comprises:

a receiver unit, which receives digital information of left-eye image and right-eye image of a current frame;

a comparison unit, which compares and determines if a combination of left-eye and right-eye gray levels of each pixel point of each scanning line of the current frame is equal to a combination of left-eye and right-eye gray levels of the corresponding position of the previous frame;

a gray level adjustment unit, which adjusts the gray level of the image of one of the eye images that is associated with each pixel point having left-eye image and right-eye image gray levels that are both different between the current frame and the previous frame resulting from the comparison result made in the comparison unit according to a gray level reference table corresponding to the scanning line in which the pixel point is located so as to adjust the gray level of each pixel point of one of the eye images to a corresponding target gray level;

a display unit, which displays one of the eye images of the current frame that is subjected to gray level adjustment for all the scanning lines and another eye image of the current frame that is not subjected to adjustment.

Preferably, further comprising:

a gray level reference table storage subunit, which stores the gray level reference table associated with each scanning line, wherein in the gray level reference table, each combination of left-eye gray level and right-eye gray level of the current frame is associated with a target gray level, the target gray level including a left-eye target gray level and a right-eye target gray level; and an image storage subunit, which stores digital information of the left-eye image and the right-eye image of the previous frame.

Preferably, further comprising:

a buffer unit, which stores the gray level adjusted image of one of eye images so as to have the gray level adjusted image form a sequence with respect to the other eye image that has not being subjected to gray level adjustment.

Preferably, the gray level adjustment unit comprises:

a target identification subunit, which, based on the combination of the left-eye gray level and the right-eye gray level of each pixel point that is determined according to the comparison result to have different levels for both the left-eye gray level and the right-eye gray level, searches the gray level reference table that is stored in the gray level reference table storage subunit and corresponds to the scanning line on which each left-eye and right-eye image pixel point is located to identify each target gray level corresponding to each of the left-eye and right-eye gray levels;

an adjustment subunit, which adjusts, for all the pixel points of which the comparison result for a combination of left-eye and right-eye gray levels is different, the left-eye gray levels to the corresponding left-eye target gray levels, or adjusts the right-eye gray levels thereof to corresponding right-eye target gray levels.

Preferably, each target gray level of the gray level reference table corresponding to each scanning line satisfies the following conditions:

in all combinations of left-eye and right-eye gray levels for one pixel point of each scanning line of the current frame, with the combinations of left-eye and right-eye gray levels of the pixel point remaining unchanged between the previous frame and the next frame, the lowest brightness level or the greatest brightness level of one eye that is measured for the pixel point of the current frame is taken as a reference brightness level; and in the gray level reference table corresponding to the scanning line, the combination of gray levels of a corresponding eye of the combination of left-eye and right-eye gray levels for the current frame is replaced with the target gray level to form an adjusted combination of left-eye and right-eye gray levels and the lowest brightness level or the greatest brightness level of the adjusted combination of left-eye and right-eye gray levels is measured to be within a deviation of 3% with respect to the corresponding reference brightness level.

An embodiment of the present invention further provides a liquid crystal display device, which comprises the device for reducing shutter 3D liquid crystal dynamic crosstalk according to any one described above.

Practicing the method and device for reducing shutter 3D liquid crystal dynamic crosstalk and the liquid crystal display device according to the present invention provides the following efficacies:

The gray level reference table for each scanning line is obtained first and stored in a 3D liquid crystal display device. After signals of left-eye image and right-eye image of the current frame are received from the 3D liquid crystal display device, the combination of left-eye and right-eye gray levels for each pixel of each scanning line of the current frame is compared with the combination of left-eye and right-eye gray levels of the previous frame at the same position to determine if they are identical. If it is different, then adjustment is carried out on the corresponding pixel according to the gray level reference table. Namely, the gray level of each pixel point of one eye of the current frame is adjusted to the corresponding target gray level. With such an adjustment, the crosstalk of left and right eyes can be alleviated or eliminated.

By applying the device and method according to the present invention to a low-cost full-area back-flashing 3d liquid crystal display device, reduced crosstalk of left eye and right eye similar to the scanning type backlight can be obtained. Applying the device and method according to the present invention to liquid crystal having a slow response time can also alleviate or eliminate crosstalk of left eye and right eye, thereby lowering down the expense that a 3D liquid crystal display device may use to eliminate or alleviate the crosstalk of left eye and right eye.

BRIEF DESCRIPTION OF THE DRAWINGS

To make clear the technical solutions according to embodiments of the present invention or the prior art, a brief description will be given to the attached drawings that are necessary for illustrating the embodiments or the prior art. Apparently, the attached drawings of which a description is given below illustrate only one or more embodiments of the present invention. For those skilled in the art, drawings other than those described herein may be easily contemplated without paying creative effort.

FIG. 3 is a schematic view showing an example of gray level reference table for the device for reducing shutter 3D liquid crystal dynamic crosstalk according to the present invention;

FIG. 4 is a schematic view showing another example of gray level reference table for the device for reducing shutter 3D liquid crystal dynamic crosstalk according to the present invention;

DETAILED DESCRIPTION OF THE PREFERRED EMBODIMENTS

A description will be given to preferred embodiments of the present invention, reference being had to the attached drawings.

Figure 1:
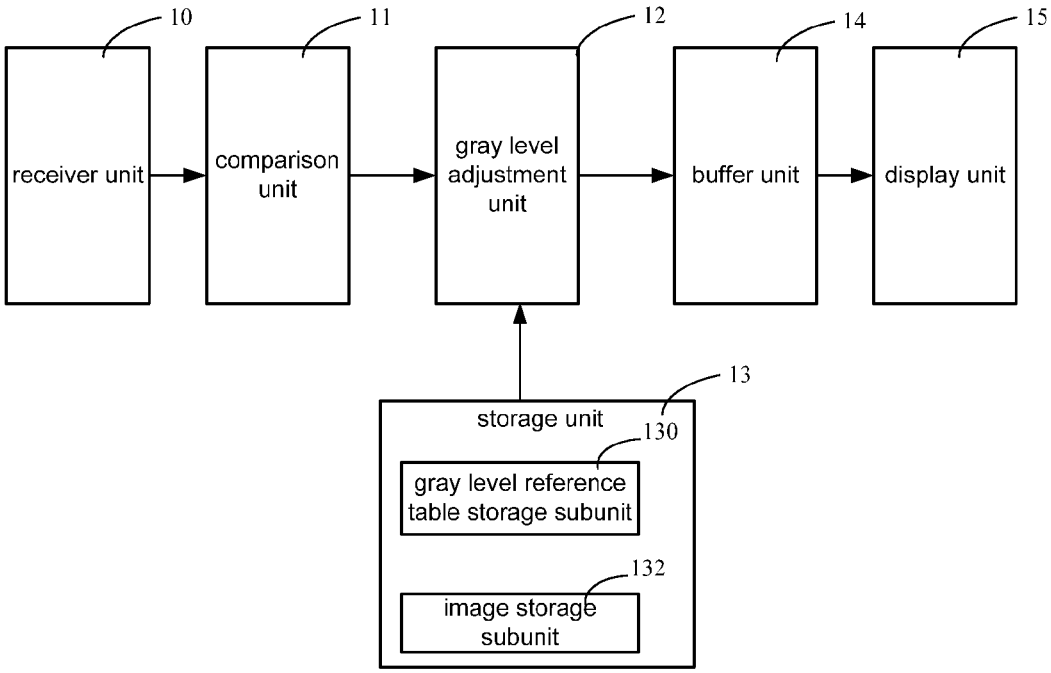
FIG. 1 is a schematic view showing a device for shutter 3D liquid crystal dynamic crosstalk according to an embodiment of the present invention.

As shown in FIG. 1, which is a schematic view showing a device for reducing shutter 3D liquid crystal dynamic crosstalk according to an embodiment of the present invention, the device for reducing shutter 3D liquid crystal dynamic crosstalk according to the present invention is installed in a shutter 3D liquid crystal display device, specifically in an original 3D signal input terminal of the shutter 3D liquid crystal display device and an intermediate path along which 3D signals are transmitted liquid crystal array display. Specifically, the present invention can be embodied with a processor chip and a peripheral circuit. It can be seen from FIG. 1 that the device of the present invention comprising:

a receiver unit 10, which receives digital information of left-eye image and right-eye image of a current frame, the digital information received including original gray level of each pixel contained in the left-eye image of the current frame and original gray level of each pixel contained in the right-eye image of the current frame;

a comparison unit 11, which compares and determines if a combination of the left-eye and right-eye gray levels of each pixel point of each scanning line of the current frame received by the receiver unit 10 is equal to a combination of left-eye and right-eye gray levels of the corresponding position of the previous frame; specifically, simultaneous comparison is made, at the location of each pixel point, between the gray level of the left-eye image of the current frame and the gray level of the left-eye image of the previous frame and between the gray level of the right-eye image of the current frame and the gray level of the right-eye image of the previous frame;

a gray level adjustment unit 12, which makes adjustment on the gray level of each associated pixel point of each scanning line of the right-eye image and the left-eye image according to the result of comparison made by the comparison unit 11, which adjustment specifically comprising:

adjusting the gray level of the image of one of the eye images (the left-eye image or the right-eye image) that is associated with each pixel point having left-eye image and right-eye image gray levels that are both different between the current frame and the previous frame resulting from the comparison result made in the comparison unit 11 according to a gray level reference table corresponding to the scanning line in which the pixel point is located so as to adjust the gray level of each pixel point of one of the eye images (the left-eye image and the right-eye image) of the current frame to a corresponding target gray level;

a buffer unit 14, which stores the gray level adjusted image of one of eye images to form a sequence with respect to the other eye image that is not subjected to gray level adjustment, wherein it is appreciated that in other embodiments, it may store the image that is not subjected to gray level adjustment to form a sequence with respect to the image of the other eye that is subjected to gray level adjustment;

a display unit 15, which displays one of the eye images of the current frame that is subjected to gray level adjustment for all the scanning lines and another eye image of the current frame that is not subjected to adjustment;

further comprising a storage unit 13, which stores the gray level reference table mentioned above and the image information of the previous frame and comprises, specifically:

a gray level reference table storage subunit 130, which stores the gray level reference table associated with each scanning line, wherein in the gray level reference table, each combination of left-eye gray level and right-eye gray level of the current frame is associated with a target gray level, the target gray level including a left-eye target gray level and a right-eye target gray level; and an image storage subunit 132, which stores digital information of the left-eye image and the right-eye image of the previous frame.

Figure 2:
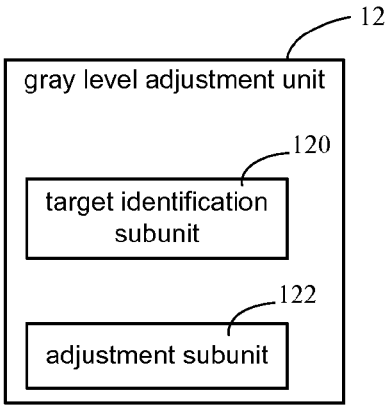
FIG. 2 is a schematic view showing a gray level adjustment unit of FIG. 1.

Also referring to FIG. 2, the gray level adjustment unit 12 comprises:

a target identification subunit 120, which, based on the combination of the left-eye gray level and the right-eye gray level of each pixel point that is determined according to the comparison result made by the comparison unit 11 to have different levels for both the left-eye gray level and the right-eye gray level, searches the gray level reference table that is stored in the gray level reference table storage subunit 130 and corresponds to the scanning line on which each left-eye and right-eye image pixel point is located to identify each target gray level corresponding to each of the left-eye and right-eye gray levels; and an adjustment subunit 122, which adjusts, for all the pixel points of which the comparison results are different, the left-eye gray levels to the corresponding left-eye target gray levels, or adjusts the right-eye gray levels thereof to corresponding right-eye target gray levels.

Figure 5:
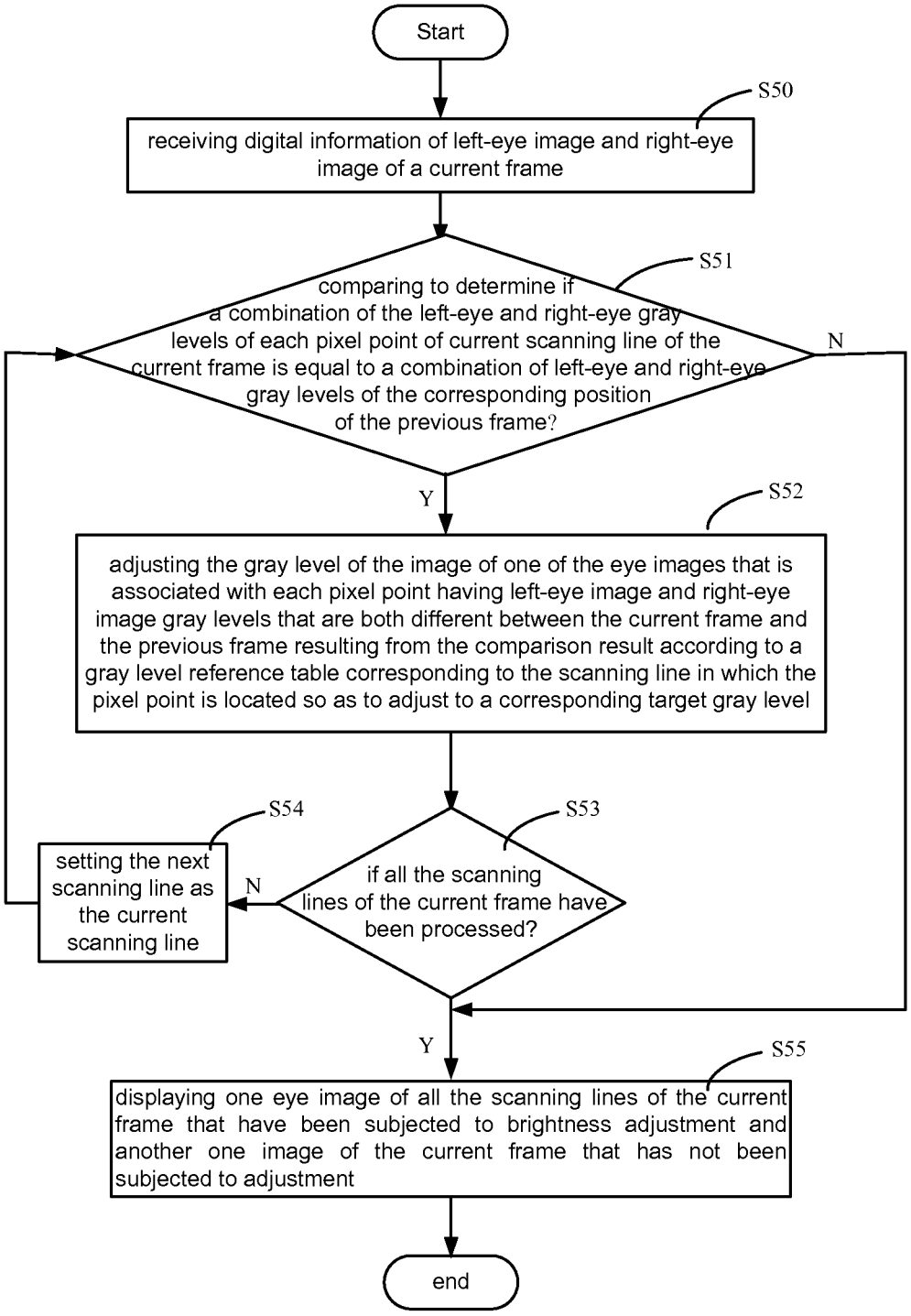
FIG. 5 is a flow chart illustrating a method for reducing shutter 3D liquid crystal dynamic crosstalk according to an embodiment of the present invention

Examples of the gray level reference table are illustrated in FIGS. 4 and 5.

The gray level reference table corresponding to each scanning line is stored in advance in the storage unit 13. In one embodiment, the gray level reference tables corresponding to different scanning lines are stored in an individual form. In other embodiments, the scanning lines of a screen may be divided into a plurality of zones (for example every five scanning line being grouped as a zone) and the scanning lines of the same zone may adopt the same gray level reference table.

Referring to FIG. 3, which is a schematic view showing an example of gray level reference table for the device for reducing shutter 3D liquid crystal dynamic crosstalk according to the present invention, the adjustment made on the left-eye gray levels of the current frame is illustrated. For example, an assumption is made that FIG. 3 shows the gray level reference table for the first scanning line. For the pixel point of left-eye image and right-eye image at corresponding position (such as the fifth pixel point of the first line), if the combination of the left-eye and the right-eye gray levels is 255/1, namely the gray level of the left-eye image of the pixel point is 255, while the gray level of the right-eye image of the pixel point is 1, then when the combination of left-eye and right-eye gray levels of the previous frame at the same position is 200/30, it is known that the combination of left-eye and right-eye gray levels of the current frame at the position is different from the combination of gray levels of the previous frame (namely the left-eye and right-eye gray levels are different from those of the previous frame). It is found from the gray level reference table that the left-eye target gray level corresponding to the combination of gray levels of the current frame (255/1) is 249 and it needs to adjust the gray level of the pixel point of the left-eye image from 255 to 249. For pixel points of the left-eye image and the right-eye image that have other combination of gray levels, the target gray levels can be found from the gray level reference table. Pixel points at other position on the scanning line may be adjusted with the target gray level reference table if the combination of the left-eye and right-eye gray levels is different from the combination of left-eye and right-eye gray levels of the previous frame.

The target gray level of the gray level reference table associated with each scanning line satisfies the following conditions:

In all combinations of left-eye and right-eye gray levels for one pixel point of each scanning line of the current frame, with the combinations of left-eye and right-eye gray levels of the pixel point remaining unchanged between the previous frame and the next frame, the lowest brightness level or the greatest brightness level of one eye that is measured for the pixel point of the current frame is taken as a reference brightness level.

In the gray level reference table corresponding to the scanning line, the combination of gray levels of one eye of the combination of left-eye and right-eye gray levels for the current frame is replaced with the target gray level to form an adjusted combination of left-eye and right-eye gray levels and the lowest brightness level or the greatest brightness level of the adjusted combination of left-eye and right-eye gray levels is measured to be within a deviation of 3% with respect to the corresponding reference brightness level.

As shown in FIG. 4, which is a schematic view showing another example of gray level reference table for the device for reducing shutter 3D liquid crystal dynamic crosstalk according to the present invention, the adjustment made on the left-eye gray levels of the current frame is illustrated. For example, an assumption is made that FIG. 3 shows the gray level reference table for the first scanning line. For the pixel point of left-eye image and right-eye image at corresponding position (such as the fifth pixel point of the first line), if the combination of the left-eye and the right-eye gray levels is 255/1, namely the gray level of the left-eye image of the pixel point is 255, while the gray level of the right-eye image of the pixel point is 1, then when the combination of left-eye and right-eye gray levels of the previous frame at the same position is 200/30, it is known that the combination of left-eye and right-eye gray levels of the current frame at the position is different from the combination of gray levels of the previous frame (namely the left-eye and right-eye gray levels are different from those of the previous frame). It is found from the gray level reference table that the right-eye target gray level corresponding to the combination of gray levels of the current frame (255/1) is 22 and it needs to adjust the gray level of the pixel point of the right-eye image from 1 to 22. For pixel points of the left-eye image and the right-eye image that have other combination of gray levels, the target gray levels can be found from the gray level reference table. Pixel points at other position on the scanning line may be adjusted with the target gray level reference table if the combination of the left-eye and right-eye gray levels is different from the combination of left-eye and right-eye gray levels of the previous frame.

The conditions that the target gray level of the gray level reference table associated with each scanning line in FIG. 4 must satisfy are similar to those of FIG. 3 and repeated description will be omitted.

It is appreciated that although a gray level reference table is used in the above embodiment to store the information of adjustment of gray level for one eye (left eye or right eye) for the combination of left-eye and right-eye gray levels of each position of each scanning line, yet other forms (such as one-to-one mapping) may alternatively used to store the information. This is considered within the scope of protection of the present invention.

Referring to FIG. 5, which is a flow chart illustrating a method for reducing shutter 3D liquid crystal dynamic crosstalk according to an embodiment of the present invention, the method comprises the following flow:

Step S50: receiving digital information of left-eye image and right-eye image of a current frame, the received digital information of the left-eye image and the right-eye image of the current frame including original gray level of each pixel contained in the left-eye image of the current frame and original gray level of each pixel contained in the right-eye image of the current frame;

Step S51: comparing to determine if a combination of the left-eye and right-eye gray levels of each pixel point of current scanning line of the current frame is equal to a combination of left-eye and right-eye gray levels of the corresponding position of the previous frame; specifically, simultaneous comparison is made, at the location of each pixel point, between the gray level of the left-eye image of the current frame and the gray level of the left-eye image of the previous frame and between the gray level of the right-eye image of the current frame and the gray level of the right-eye image of the previous frame;

the flow going to Step S52 if result of comparison of Step S51 indicates that the left-eye and right-eye gray levels of the current frame are both different from those of the previous frame; the flow going to Step S55 if the result of comparison of Step S51 indicates that the gray level of one eye is identical;

Step S52: adjusting the gray level of the image of one of the eye images (the left-eye image or the right-eye image) that is associated with each pixel point having left-eye image and right-eye image gray levels that are both different between the current frame and the previous frame resulting from the comparison result made in the Step S51 according to a gray level reference table corresponding to the scanning line in which the pixel point is located so as to adjust the gray level of each pixel point of one of the eye images (the left-eye image and the right-eye image) of the current frame to a corresponding target gray level, wherein the gray level reference table for each scanning line is defined in advance and in the gray level reference table, each combination of left-eye gray level and right-eye gray level of the current frame is associated with a target gray level, the target gray level including a left-eye target gray level and a right-eye target gray level.

Specifically, in this Step, based on the position of each pixel point that has the result of comparison being both different, searches are made on the previously stored gray level reference table that corresponds to the scanning line on which the pixel point is located to identify each target gray level corresponding to the combination of left-eye and right-eye gray levels of the current frame of each pixel point;

For all the pixel points of which the comparison results are different, the gray level of one eye is adjusted to the corresponding target gray level. For example, the left-eye gray level of each position is adjusted to the corresponding left-eye target gray levels, or the right-eye gray level thereof is adjusted to corresponding right-eye target gray level.

Step S53: after the adjustment of gray level for a pixel point of one eye of the current scanning line of the current frame, determining if the gray levels of the pixel points of all the scanning lines of the current frame for said eye have been adjusted?

If it is determined that the adjustment has not yet been completely done, then in Step S54, setting the next scanning line as the current scanning line and the flow goes to Step S51 to make adjustment on the gray level of each pixel of the left-eye and the right-eye images.

If it is determined that the adjustment has been completely done, then in Step S55, displaying one eye image of all the scanning lines of the current frame that have been subjected to gray level adjustment and another one image of the current frame that has not been subjected to adjustment.

Further, in an embodiment of the present invention, Step S55 further comprises storing one of the eyes (such as the image that has been subjected to gray level adjustment) and with the other eye image (such as the image that has not been subjected to gray level adjustment) in order to have the two eye images to be transmitted and displayed in sequence.

The target gray level of the gray level reference table associated with each scanning line satisfies the following conditions:

In all combinations of left-eye and right-eye gray levels for one pixel point of each scanning line of the current frame, with the combinations of left-eye and right-eye gray levels of the pixel point remain unchanged between the previous frame and the next frame, the lowest brightness level or the greatest brightness level of one eye that is measured for the pixel point of the current frame is taken as a reference brightness level.

In the gray level reference table corresponding to the scanning line, the combination of gray levels of one eye of the combination of left-eye and right-eye gray levels for the current frame is replaced with the target gray level to form an adjusted combination of left-eye and right-eye gray levels and the lowest brightness level or the greatest brightness level of the adjusted combination of left-eye and right-eye gray levels is measured to be within a deviation of 3% with respect to the corresponding reference brightness level.

A further description will be given, with reference to FIGS. 6 and 7, to an example of generating the gray level reference table corresponding to each scanning line and the principle of the gray level reference table corresponding to each scanning line.

Figure 6:
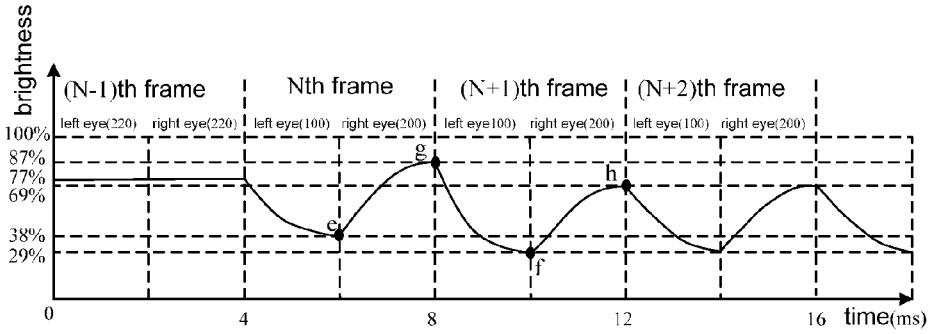
FIG. 6 is a schematic view showing a brightness-time curve without being subjected to gray level adjustment according to an example of the present invention and FIG. 7 is a schematic view showing a brightness-time curve being subjected to gray level adjustment according to an example of the present invention.

Referring to FIG. 6, which is a schematic view showing a brightness-time curve without being subjected to gray level adjustment according to an example of the present invention, it can be seen that in the example, taking a first pixel of a first scanning line as an example, the combinations of left-eye and right-eye gray levels for four consecutive frame (front (N−1) th frame to (N+1)th frame) are respectively 220/220, 100/200,100/200, and 100/200. The brightness-time curve shown in FIG. 6 for the four frames is obtained through measurement made with a photo sensor. It can be found that the combination of left-eye and right-eye gray levels of the Nth frame is different from the combination of left-eye and right-eye gray levels of the previous frame (the (N−1)th frame). For a 3D liquid crystal display device that uses one-zone flashing LED backlighting, due to the insufficiency of the liquid crystal response time, this phenomenon will cause a dynamic crosstalk phenomenon of the left and right eyes. Ideally, when the combination of left-eye and right-eye gray levels changes from 220/220 to 100/200, after getting steady, the brightness should be between f (29%) and h (77%). Thus, f and h are respectively referred to as the minimum reference brightens and the maximum reference brightness.

However, the measured brightness of the current frame is between e (38%) and g (87%). The kind of situation where the gray levels of both the left eye and the right eye vary simultaneously results in a difference existing between the brightness displayed on the 3D liquid crystal display device and the reference brightness thereby causing the occurrence of dynamic crosstalk for left eye and right eye. Thus, it needs to devise a solution to have the brightness of the pixel of the current frame (the Nth frame) adjusted to or close to the reference brightness.

In all combinations of left-eye and right-eye gray levels for one pixel point of each scanning line, with the combinations of left-eye and right-eye gray levels of the pixel point remaining unchanged between the previous frame and the next frame, the lowest brightness level or the greatest brightness level of one eye that is measured for the pixel point of the current frame is taken as a reference brightness level.

Figure 7:
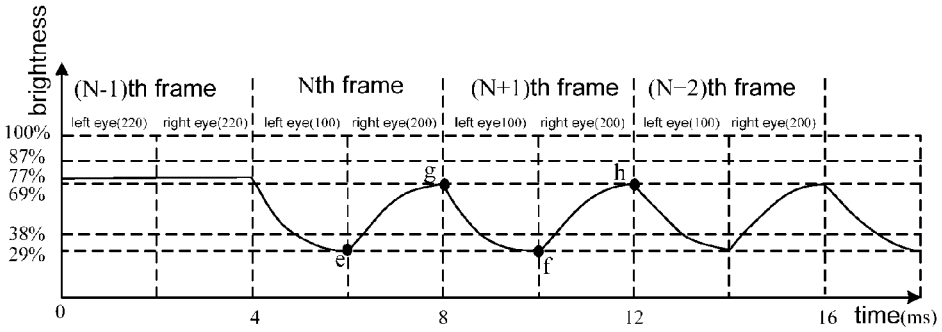

Referring to FIG. 7, which is a schematic view showing a brightness-time curve being subjected to gray level adjustment according to an example of the present invention, it can be seen that after being subjected to adjustment, the maximum level (g) and the minimum level (h) of the brightness displayed on the pixel point for the current frame (the Nth frame) becomes identical to f and h. This adjustment is done by changing the left-eye gray level of the current frame. It can be seen from the drawing that the left-eye gray level of the current frame is changed from the original value of 100 to 70. This establishes a corresponding relationship, namely the left-eye gray level of the combination of current left-eye and right-eye gray levels, which is 100/200, being changed to 70, and thus, the brightness of the current frame matches the expected reference brightness (or curve). Consequently, the combination of left-eye and right-eye gray levels that is 100/200 forms a corresponding relationship with respect to the adjustment that sets the left-eye gray level to the target gray level of 70.

Based on such a principle, through measurement, the target gray levels for other combinations of left-eye and right-eye gray levels of the scanning line can be obtained to thereby establish the gray level reference table associated with the scanning line as shown in FIG. 3. The gray level reference table for each scanning line, after being completed, is stored in a storage of the 3D liquid crystal display device.

For similar way, adjustment can be made on the right eye. Under this condition, through measurement, the right-eye target gray level corresponding to each combination of left-eye and right-eye gray levels can be obtained to thereby form the gray level reference table of FIG. 4, of which the principle is similar to that of FIG. 3 so that further details will be omitted.

In other embodiments, the selection of target gray level may be such that it is not necessary for adjustment to be made to completely match the expected maximum (h) and minimum (f). For example, a difference of small range (such as 3%) between the brightness displayed for the adjusted combination of gray levels and the associated reference brightness may basically achieve the purpose of the present invention, namely satisfying the following conditions:

(adjusted minimum brightness−minimum reference brightness)/minimum reference brightness) *100%<3%, or (adjusted maximum brightness−maximum reference brightness)/maximum reference brightness) *100%<3%

Thus, the gray level reference table for the current scanning line is not a sole one. However, if the gray level reference table has been stored, then the adjustment made on the two-dimensional signal shown in FIG. 5 may be carried out by using the stored gray level reference table.

According to the above principle, when the combination of left-eye and right-eye gray levels of the current frame for a pixel is different from the combination of left-eye and right-eye gray levels of the previous frame for the same position, the gray level of one eye (left eye or right eye) of the current frame can be adjusted to a previously confirmed target gray level so as to have the brightness displayed at the position of the pixel of the current frame reach or approximate the reference brightness thereof. Consequently, the dynamic crosstalk for left and right eyes can be eliminated or alleviated.

Further, the present invention also provides a shutter 3D liquid crystal display device, which comprises the device for reducing shutter 3D liquid crystal dynamic crosstalk shown in FIGS. 1 and 2, where the principle for embodiment thereof is illustrated with reference to FIGS. 1-7, all details being discussed in the above description with reference to FIGS. 1-7 so that further discussion is omitted.

To practice the present invention, the gray level reference table for each scanning line is obtained first and stored in a 3D liquid crystal display device. After signals of left-eye image and right-eye image of the current frame are received from the 3D liquid crystal display device, the combination of left-eye and right-eye gray levels for each pixel of each scanning line of the current frame is compared with the combination of left-eye and right-eye gray levels of the previous frame at the same position to determine if they are identical. If it is different, then adjustment is carried out on the corresponding pixel according to the gray level reference table. Namely, the gray level of each pixel point of one eye of the current frame is adjusted to the corresponding target gray level. With such an adjustment, the crosstalk of left and right eyes can be alleviated or eliminated.

By applying the device and method according to the present invention to a low-cost full-area back-flashing 3d liquid crystal display device, reduced crosstalk of left eye and right eye similar to the scanning type backlight can be obtained. Applying the device and method according to the present invention to liquid crystal having a slow response time can also alleviate or eliminate crosstalk of left eye and right eye, thereby lowering down the expense that a 3D liquid crystal display device may use to eliminate or alleviate the crosstalk of left eye and right eye.

What is disclosed above are preferred embodiments of the present invention and are not intended for limiting the claims of the present invention. Thus, equivalent modifications are considered within the scope of the present invention.

What is claimed is:

1. A method for reducing shutter 3-dimension (3D) liquid crystal dynamic crosstalk, characterized by comprising:

receiving digital information of left-eye image and right-eye image of a current frame;

comparing to determine if a combination of the left-eye and right-eye gray levels of each pixel point of each scanning line of the current frame is equal to a combination of left-eye and fight-eye gray levels of the corresponding position of the previous frame;

adjusting the gray level of the image of one of the eye images that is associated with each pixel point having left-eye image and right-eye image gray levels that are both different between the current frame and the previous frame resulting from the comparison result according to a gray level reference table corresponding to the scanning line in which the pixel point is located so as to adjust the gray level of each pixel point of one of the eye images of the current frame to a corresponding target gray level; and displaying one eye image of all the scanning lines of the current frame that have been subjected to gray level adjustment and another one image of the current frame that has not been subjected to adjustment, wherein the gray level reference table for each scanning line is defined in advance and in the gray level reference table, each combination of left-eye gray level and fight-eye gray level of the current frame is associated with a target gray level, the target gray level including a left-eye target gray level and a right-eye target gray level.

2. The method for reducing shutter 3D liquid crystal dynamic crosstalk as claimed in claim 1, characterized in that the step of adjusting the gray level of the image of one of the eye images that is associated with each pixel point having left-eye image and right-eye image gray levels that are both different between the current frame and the previous frame resulting from the comparison result according to a gray level reference table corresponding to the scanning line in which the pixel point is located so as to adjust the gray level of each pixel point of one of the eye images of the current frame to a corresponding target gray level comprises:

searching a previously stored gray level reference table corresponding to the scanning line where the pixel is located according to the position of each pixel of which the comparison result is different to find out each target gray level corresponding to the combination of left-eye and right-eye gray levels of the current frame for each pixel;

adjusting the left-eye gray level of the pixel where the comparison result of the left-eye gray level and the right-eye gray level are both different between the current frame and the previous frame to the corresponding left-eye gray level or adjusting the right-eye gray level to the corresponding right-eye target gray level.

3. The method for reducing shutter 3D liquid crystal dynamic crosstalk as claimed in claim 2, characterized in that each target gray level of the gray level reference table corresponding to each scanning line satisfies the following conditions:

in all combinations of left-eye and right-eye gray levels for one pixel point of each scanning line of the current frame, with the combinations of left-eye and right-eye gray levels of the pixel point remaining unchanged between the previous frame and the next frame, the lowest brightness level or the greatest brightness level of one eye that is measured for the pixel point of the current frame is taken as a reference brightness level; and in the gray level reference table corresponding to the scanning line, the combination of gray levels of a corresponding eye of the combination of left-eye and right-eye gray levels for the current frame is replaced with the target gray level to form an adjusted combination of left-eye and right-eye gray levels and the lowest brightness level or the greatest brightness level of the adjusted combination of left-eye and right-eye gray levels is measured to be within a deviation of 3% with respect to the corresponding reference brightness level.

4. A method for reducing shutter 3-dimension (3D) liquid crystal dynamic crosstalk, comprising:

receiving digital information of left-eye image and right-eye image of a current frame;

comparing to determine if a combination of the left-eye and right-eye gray levels of each pixel point of each scanning line of the current frame is equal to a combination of left-eye and right-eye gray levels of the corresponding position of the previous frame;

adjusting the gray level of the image of one of the eye images that is associated with each pixel point having left-eye image and right-eye image gray levels that are both different between the current frame and the previous frame resulting from the comparison result according to a gray level reference table corresponding to the scanning line in which the pixel point is located so as to adjust the gray level of each pixel point of one of the eye images of the current frame to a corresponding target gray level; and displaying one eye image of all the scanning lines of the current frame that have been subjected to gray level adjustment and another one image of the current frame that has not been subjected to adjustment, wherein the step of displaying one eye image of all the scanning lines of the current frame that have been subjected to gray level adjustment and another one image of the current frame that has not been subjected to adjustment further comprises:

storing the image of one eye that has been subjected to gray level adjustment so as to have the image that has been subjected to gray level adjustment to form a sequence with the image of the other eye that has not subjected to adjustment.

5. A device for reducing shutter 3-dimension (3D) liquid crystal dynamic crosstalk, characterized by comprising:

a receiver unit, which receives digital information of left-eye image and right-eye image of a current frame;

a comparison unit, which compares and determines if a combination of left-eye and right-eye gray levels of each pixel point of each scanning line of the current frame is equal to a combination of left-eye and right-eye gray levels of the corresponding position of the previous frame;

a gray level adjustment unit, which adjusts the gray level of the image of one of the eye images that is associated with each pixel point having left-eye image and right-eye image gray levels that are both different between the current frame and the previous frame resulting from the comparison result made in the comparison unit according to a gray level reference table corresponding to the scanning line in which the pixel point is located so as to adjust the gray level of each pixel point of one of the eye images of the current frame to a corresponding target gray level;

a display unit, which displays one of the eye images of the current frame that is subjected to gray level adjustment for all the scanning lines and another eye image of the current frame that is not subjected to adjustment;

a gray level reference table storage subunit, which stores the gray level reference table associated with each scanning line, wherein in the gray level reference table, each combination of left-eye gray level and right-eye gray level of the current frame is associated with a target gray level, the target gray level including a left-eye target gray level and a right-eye target gray level; and an image storage subunit, which stores digital information of the left-eye image and the right-eye image of the previous frame.

6. The device for reducing shutter 3D liquid crystal dynamic crosstalk as claimed in claim 5, characterized by further comprising:

a buffer unit, which stores the gray level adjusted image of one of eye images so as to have the gray level adjusted image form a sequence with respect to the other eye image that has not being subjected to gray level adjustment.

7. The device for reducing shutter 3D liquid crystal dynamic crosstalk as claimed in claim 5, characterized in that the gray level adjustment unit comprises:

a target identification subunit, which, based on the combination of the left-eye gray level and the right-eye gray level of each pixel point that is determined according to the comparison result to have different levels for both the left-eye gray level and the right-eye gray level, searches the gray level reference table that is stored in the gray level reference table storage subunit and corresponds to the scanning line on which each left-eye and right-eye image pixel point is located to identify each target gray level corresponding to each of the left-eye and right-eye gray levels;

an adjustment subunit, which adjusts, for all the pixel points of which the comparison result for a combination of left-eye and right-eye gray levels is different, the left-eye gray levels to the corresponding left-eye target gray levels, or adjusts the right-eye gray levels thereof to corresponding right-eye target gray levels.

8. The device for reducing shutter 3D liquid crystal dynamic crosstalk as claimed in claim 7, characterized in that each target gray level of the gray level reference table corresponding to each scanning line satisfies the following conditions:

in all combinations of left-eye and right-eye gray levels for one pixel point of each scanning line of the current frame, with the combinations of left-eye and right-eye gray levels of the pixel point remaining unchanged between the previous frame and the next frame, the lowest brightness level or the greatest brightness level of one eye that is measured for the pixel point of the current frame is taken as a reference brightness level; and in the gray level reference table corresponding to the scanning line, the combination of gray levels of a corresponding eye of the combination of left-eye and right-eye gray levels for the current frame is replaced with the target gray level to form an adjusted combination of left-eye and right-eye gray levels and the lowest brightness level or the greatest brightness level of the adjusted combination of left-eye and right-eye gray levels is measured to be within a deviation of 3% with respect to the corresponding reference brightness level.

9. A liquid crystal display device, characterized by comprising the device for reducing shutter 3D liquid crystal dynamic crosstalk according to any one of claims 5 and 6-8.

* * * * *